US006221312B1

(12) United States Patent
Van Laar et al.

(10) Patent No.: US 6,221,312 B1
(45) Date of Patent: Apr. 24, 2001

(54) REFRACTORY WALL, METALLURGICAL VESSEL COMPRISING SUCH A REFRACTORY WALL AND METHOD IN WHICH SUCH A REFRACTORY WALL IS APPLIED

(75) Inventors: Jacobus Van Laar, Driehuis; Gerardus Jozef Tijhuis, Heemskerk, both of (NL)

(73) Assignee: Hoogovens Staal B.V., Ca Ijmuiden (NL)

( * ) Notice: Subject to any disclaimer, the term of this patent is extended or adjusted under 35 U.S.C. 154(b) by 0 days.

(21) Appl. No.: 09/355,352

(22) PCT Filed: Jan. 28, 1998

(86) PCT No.: PCT/EP98/00518

§ 371 Date: Sep. 23, 1999

§ 102(e) Date: Sep. 23, 1999

(87) PCT Pub. No.: WO98/32883

PCT Pub. Date: Jul. 30, 1998

(30) Foreign Application Priority Data

Jan. 29, 1997 (NL) ..... 1005114

(51) Int. Cl.[7] ..... C21B 7/10

(52) U.S. Cl. ..... 266/193; 266/241; 266/286

(58) Field of Search ..... 266/193, 241, 266/280, 283, 286

(56) References Cited

U.S. PATENT DOCUMENTS

| | | | | |
|---|---|---|---|---|
| 4,849,015 | | 7/1989 | Fassbinder | 75/26 |
| 5,662,860 | * | 9/1997 | Kiaassen et al. | 266/193 |
| 5,676,908 | * | 10/1997 | Kubbutat et al. | 266/193 |

FOREIGN PATENT DOCUMENTS 3607774 3/1986 (DE) .

* cited by examiner

*Primary Examiner*—Scott Kastler
(74) *Attorney, Agent, or Firm*—Stevens, Davis, Miller & Mosher, LLP

(57) ABSTRACT

Refractory wall structure, suitable in particular for use in a metallurgical vessel for a continuous production of crude iron in a smelting reduction process under conditions of an extremely high thermal load in a highly abrasive environment of molten slag with a high FeO content, comprising, going from the outside to the inside,
(1) a steel jacket;
(2) a water-cooled copper wall;
(3) water-cooled copper ledges extending towards the inside;
(4) a lining of refractory material resting on the ledges.

23 Claims, 5 Drawing Sheets

REFRACTORY WALL, METALLURGICAL VESSEL COMPRISING SUCH A REFRACTORY WALL AND METHOD IN WHICH SUCH A REFRACTORY WALL IS APPLIED

The invention relates to a refractory wall structure, suitable in particular for use in a metallurgical vessel for a continuous production of crude iron in a smelting reduction process under conditions of an extremely high thermal load in a highly abrasive environment of molten slag with a high FeO content. The invention also relates to a metallurgical vessel and to a method for a continuous production of crude iron, in particular for the final reduction of the Cyclone Converter Furnace (CCF) smelting reduction process.

According to the state of the art crude iron is produced in a blast furnace. In this process iron ore is reduced with the aid of coke. There are different processes being developed for the direct reduction of iron ore which however not yet have been applied industrially. The most promising are the so-called in-bath smelting reduction processes. A bottleneck with these processes is the service life of the refractory wall structure of the metallurgical vessel in which the reduction into crude iron takes place. This is determined by a particularly high thermal load and a highly abrasive environment due to the presence of FeO at a temperature level of approximately 1,700° C. In the case of a blast furnace whereby the same conditions occur in a somewhat less aggressive form and whereby a thermal load of 300,000 $W/m^2$ can occur, the refractory wall structure consists, at its most threatened place, going from the outside to the inside, of an armour-plating and a lining of refractory bricks, for example bricks containing SiC which is cooled by cooling elements. Cooling elements according to the state of the art are either so-called cooling plates, reaching removably into the lining, as described in Dutch patent application NL 7312549 A, or so-called staves which form a water-cooled wall between the armour-plating and the lining. At present with this structure it is possible to reach a service life in the order of 10 years. European patent application EP 0 690 136 A1 describes an apparatus in which iron compounds in particle form are melted in a gas atmosphere. The shell or armour construction of this apparatus is water-cooled. With smelting reduction processes the thermal load is much higher and can even reach 2,000,000 $W/m^2$ locally. Therefore no acceptable service life can be achieved with a known wall structure for a blast furnace.

The object of the invention is to provide a wall structure for a process of direct reduction which has an acceptable service life.

This is achieved in accordance with the invention with a wall structure comprising, going from the outside to the inside, (1) a steel jacket;

(2) a water-cooled copper wall;

(3) water-cooled copper ledges extending towards the inside;

(4) a lining of refractory material resting on the ledges.

With this basic structure it is possible, due to a maximal thermal contact between the lining and the water-cooled copper wall -and ledges, to realise a refractory wall structure with which a low thermal resistance is attained. As a result of this even under a high thermal load a good stable residual thickness of the lining is achieved resulting in a long service life. The most threatened area in the metallurgical vessel in which the reduction into iron ore takes place is where the molten slag layer containing a high amount of FeO floats on the crude iron bath. There the lining wears away to a balanced residual thickness onto which a layer of slag solidifies which layer functions as a wearing and insulation layer. The solidified layer stops the lining being attacked and the structure is capable to resist further attack. The cooling by the ledges improves the service life of the refractory structure.

Preferably the ledges are preferably movable vertically. The advantage of this is that, when being assembled cold, the refractory wall structure can settle in the vertical direction under the effect of its own weight so that the horizontal joints are closed as much as possible.

Preferably the ledges at the top extend upwards towards the inside obliquely, the ledges at the bottom extend downwards towards the inside obliquely, and the ledges are distributed up the height of the wall. The advantage of this is that the lining is secured relative to the water-cooled copper wall.

Preferably the water-cooled copper wall is composed of panels. This facilitates fabrication and assembly of the water-cooled copper wall.

Preferably the ledges are installed staggered in height up the width and/or the circumference. This achieves the effect that the passages of the cooling water feed and discharge pipes are distributed uniformly throughout the steel jacket and clusters of them are avoided.

Preferably the lining rests without mortar on the ledges and the lining bears against the water-cooled wall without mortar. This avoids high thermal resistances as a consequence of mortar-filled joints, and is it possible to allow a high thermal load.

Preferably the lining is composed of blocks of graphite with a coefficient of thermal conductivity in the range 60–150 W/m° K and/or of blocks of semi-graphite with a coefficient of thermal conductivity in the range 30–60 W/m° K. As a result of the high coefficient of thermal conductivity a low thermal resistance is achieved as a cause of which it is possible to allow a high thermal load.

In an alternative embodiment the lining preferably consists of refractory bricks, more preferably of bricks of a type that is used in converters for steel production or in electric furnaces for steel production and most preferably the bricks are magnesite-carbon bricks. Bricks of this type known for steel production have a high resistance to abrasion.

Preferably, going from the outside to the inside, the lining consists of a layer of graphite which bears against the copper wall and a layer of refractory bricks. With this embodiment, once the balanced thickness has established itself, the lining consists of a layer of wear resistant refractory bricks and a layer of graphite with a low thermal resistance.

Preferably the wall inclines backwards from bottom to top. This improves the stability of the lining. In addition this widening shape achieves the effect that the level of the slag layer in the metallurgical vessel varies less.

Preferably the copper wall and/or the copper ledges consists of red copper with a content of ≧99% Cu and a coefficient of thermal conductivity in the range 250–300 W/m° K. This achieves an acceptably low thermal resistance of these elements.

Preferably the steel jacket forms part of a pressure vessel and the passages through the steel jacket of cooling water feed and discharge pipes of the water-cooled copper wall and the water-cooled copper ledges are sealed following assembly of the wall. This achieves the effect that the process may be run under overpressure.

Preferably the wall is resistant against a thermal load of over 300,000 $W/m^2$ and against slag with approximately 10% wt. FeO at a temperature level of approximately 1,700° C., and the wall has a service life of at least 6 months continuous use. This allows the wall to be operated under conditions of a high thermal load in a highly abrasive environment with an acceptable service life.

In another aspect the invention is embodied in a metallurgical vessel, in particular for the final reduction of the Cyclone Converter Furnace (CCF) smelting reduction process that comprises a refractory wall structure in accordance with the invention.

In yet another aspect the invention is embodied in a method for a continuous production of crude iron, in particular for the final reduction of the Cyclone Converter Furnace (CCF) smelting reduction process in a metallurgical vessel in which a refractory wall structure in accordance with the invention is applied.

BRIEF DESCRIPTION OF THE DRAWINGS

The invention will now be illustrated in the following by reference to non-limitative drawings.

Figure 1:
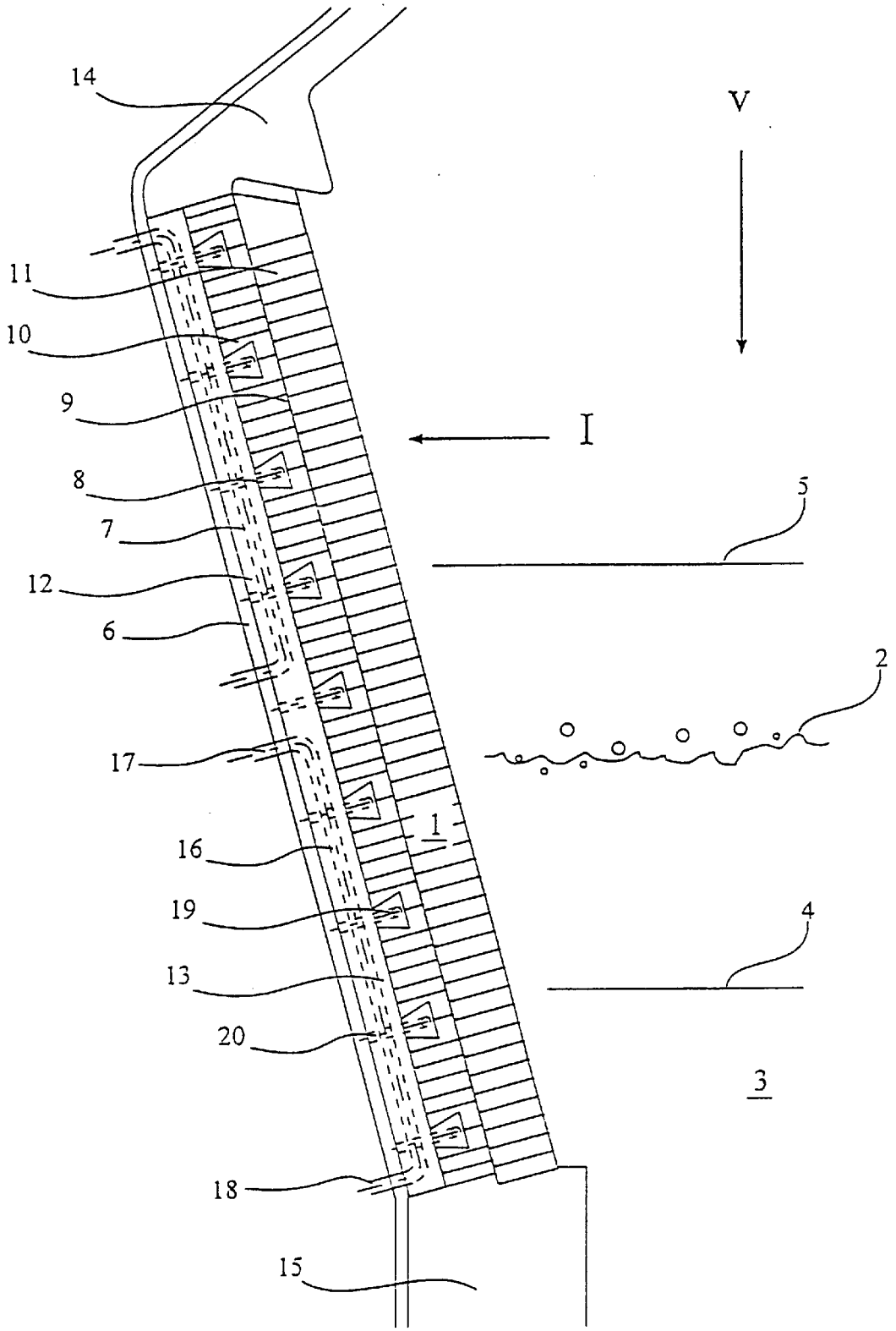
FIG. 1 shows an assembly of the refractory wall structure in a vertical cross-section.

The drawing shows the invention in an embodiment which is developed for a metallurgical vessel in which the reduction into crude iron takes place by means of the Cyclone Converter Furnace (CCF) smelting reduction process. However, the invention is not limited to this application and is also suitable for application in other processes for reducing iron ore with a high thermal load and/or a highly abrasive environment due to FeO.

FIG. 1 shows a refractory wall structure (1) in accordance with the invention forming part of a metallurgical vessel. (2) indicates the level of the slag layer floating in the metallurgical vessel on a crude iron bath (3), with (4) and (5) indicating the minimum and maximum levels of the slag layer respectively.

The refractory wall structure comprises a steel jacket (6), a water-cooled copper wall (7), water-cooled ledges (8) and a lining (9), which in the case of FIG. 1 consists of graphite blocks (10) and refractory bricks (11).

There is shown that in the case of FIG. 1 the refractory wall structure inclines backwards relative to the vertical V from bottom to top. In the direction of its height the water-cooled copper wall (7) consists of two panels (12) and (13). Each panel is provided with four ledges (8). Between every two ledges six graphite blocks are placed. In front of these graphite blocks is placed an equal number of refractory bricks in each case. The steel jacket (6) continues above and below the refractory wall structure and on the inside of the metallurgical vessel it is also provided with a refractory structure (14) and (15), the nature of which in accordance with this application is irrelevant. The weight of the refractory wall structure (1) is taken up at least in part by the refractory structure (15) lying beneath it. Panels (12) and (13) are provided internally with cooling water ducts (16) with couplings (17) and (18) for the feed and discharge of cooling water which are transported towards the outside of the metallurgical vessel through steel jacket (6). Ledges (8) are also provided internally with a cooling water duct (19) with cooling water coupling (20) towards the outside of the metallurgical vessel. Shown is that the ledges (8) at the top run up obliquely inwards and at the bottom run down obliquely inwards. In contrast to the wall structure as known for a blast furnace whereby the lining of refractory bricks is jointed with mortar, lining (9) rests on ledges (8) without mortar and bears without mortar against water-cooled wall (7). The water-cooled wall (7) and the ledges (8) are made from red copper with ≧99% Cu. The graphite blocks (10) have a coefficient of thermal conductivity in the range 60–150 W/m° K. Refractory bricks (11) are magnesite-carbon bricks.

Figure 2:
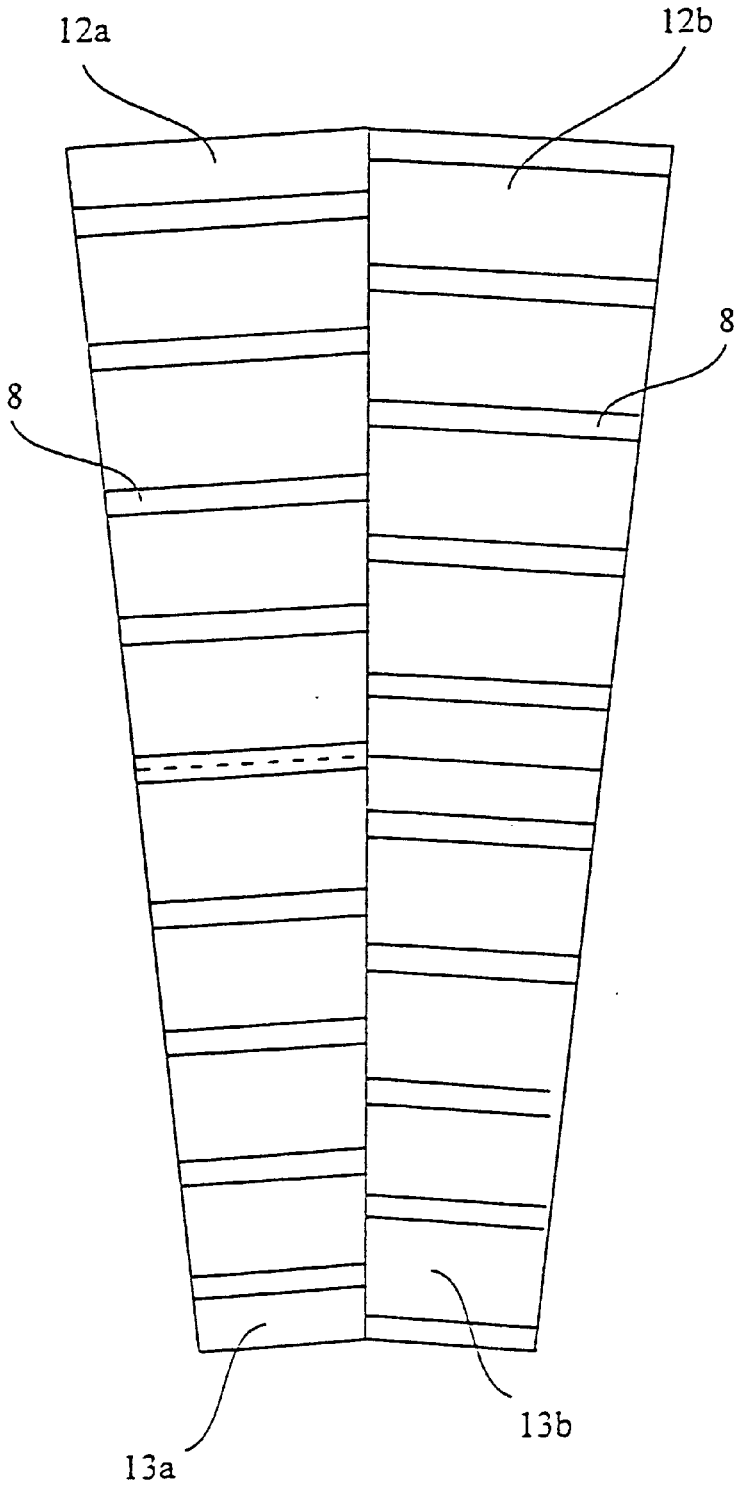
FIG. 2 shows a view of the refractory wall structure in accordance with arrow I in FIG. 1.

FIG. 2 shows a part of the circumference of the refractory wall structure whereby the lining (9) is omitted. The part comprises four panels (12A), (12B), (13A) and (13B), each of which are approximately 2.4 m high and 1 m wide. The ledges (8) are staggered in height in the direction of the circumference.

Figure 3:
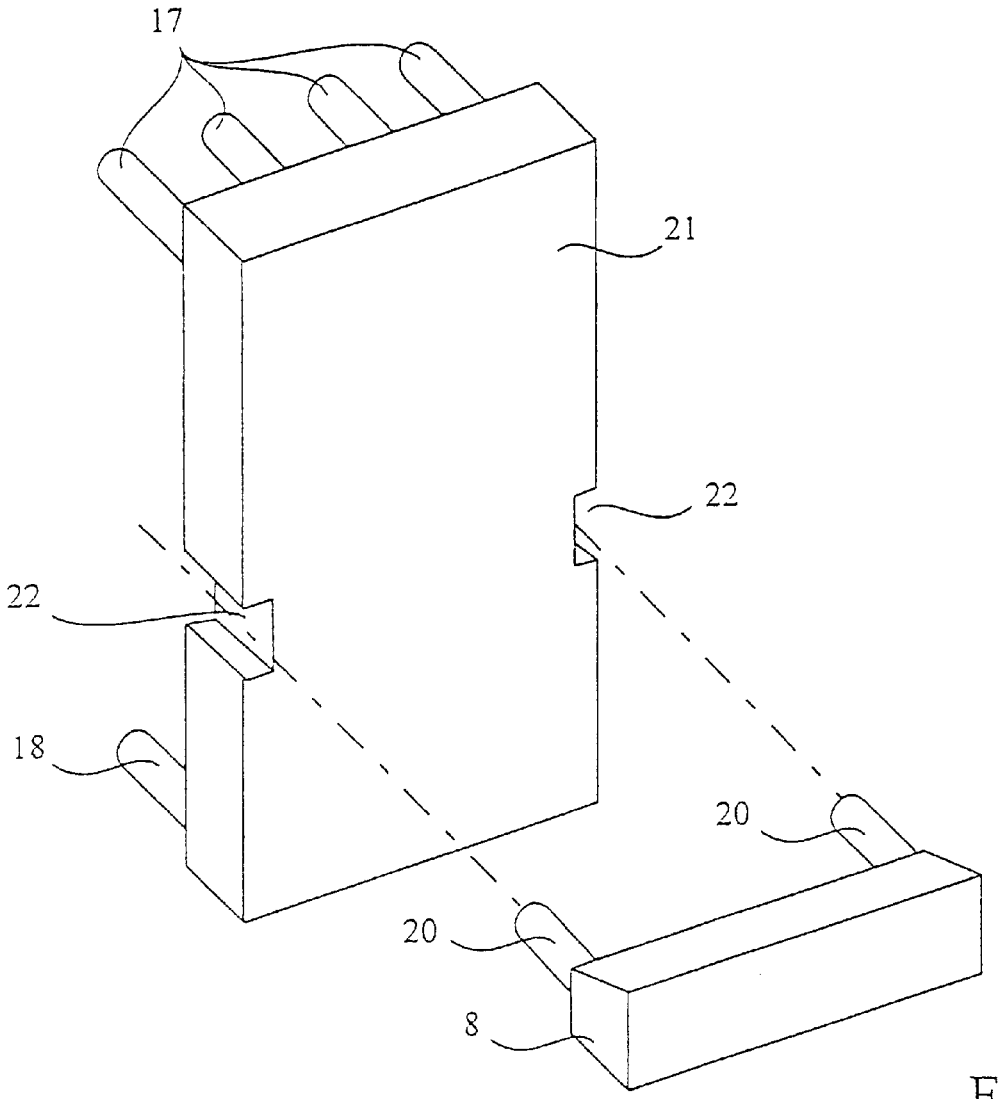
FIG. 3 shows a sub-assembly of a water-cooled copper wall panel and a water-cooled copper ledge in non-assembled state.

The number of cooling-water feed and discharge ducts (17) and (18) shows panel (21) of FIG. 3 to have four internal cooling ducts- There is shown that for the sake of the cooling water feed and discharge ducts (20) of ledge (8) recesses (22) are placed in cooling panel (21), of which only one set is shown in FIG. 3 (in FIG. 1 there were four ledges (8) per panel).

Figure 4:
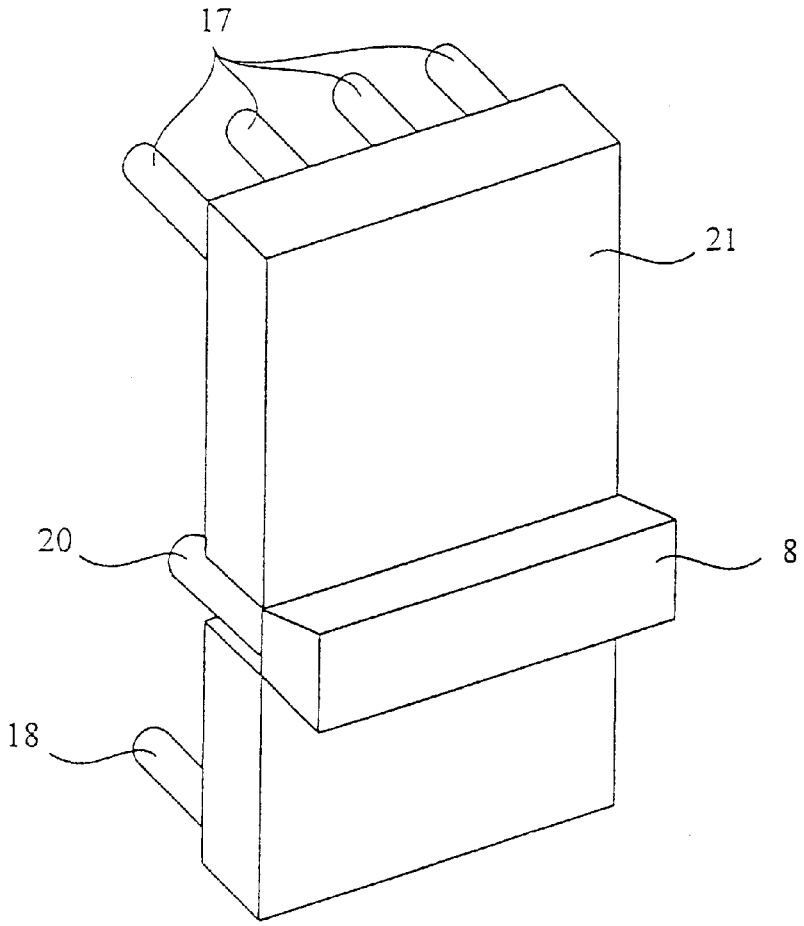
FIG. 4 shows a sub-assembly of a water-cooled copper wall panel and a water-cooled ledge in assembled state.

FIG. 4 shows a cooling panel (21) and a ledge (8) in assembled state.

Figure 5:
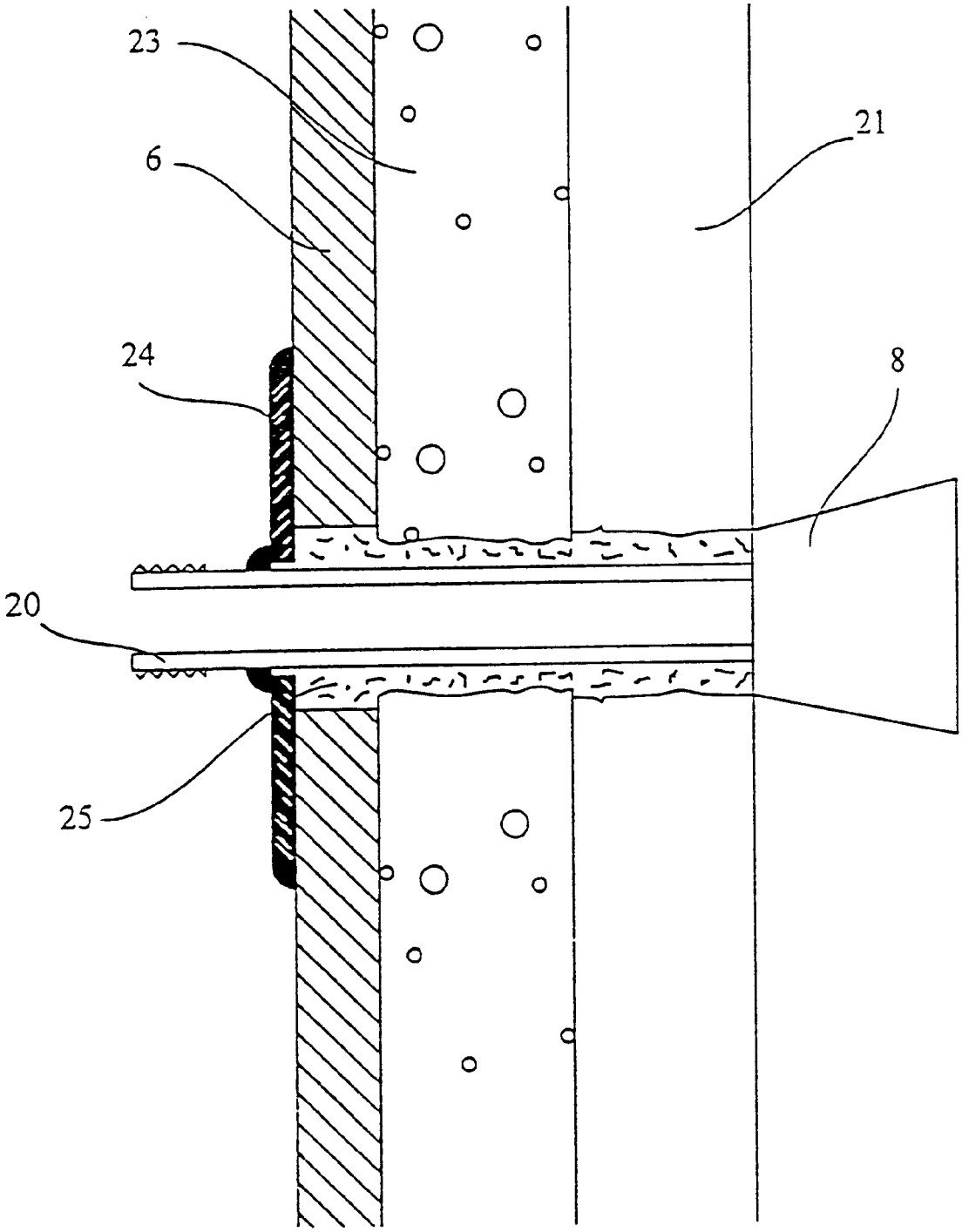
FIG. 5 shows a detail of the seal of a passage of a cooling water feed or discharge pipe in the steel jacket.

FIG. 5 shows the passage of a cooling water pipe (20) of ledge (8) through panel (21) and the steel jacket (6), whereby following cold assembly of the refractory wall structure the seal takes place with the aid of plate (24) which is welded to pipe (20) and steel jacket (6). A concrete lining can be placed between panel (21) and steel jacket (6). The remaining space (25) in the loose gap between on the one side pipe (20) and panel (21), concrete (23) and jacket (6) on the other side is filled up with mortar or felt.

A refractory wall structure in accordance with the invention is resistant to a thermal load of over 300,000 W/m$^2$ and to slag with approximately 10% FeO at a temperature level of 1,700° C. with a service life of at least 6 months.

This manner achieves the effect that the metallurgical vessel, or at least its slag zone, does not need to be frequently changed or repaired, but rather that a service life comparable to that of a modern blast furnace is achieved.

What is claimed is:

1. Refractory wall structure (1), suitable for use in a metallurgical vessel for a continuous production of crude iron in a smelting reduction process under conditions of an extremely high thermal load in a highly abrasive environnient of molten slag with a high FeO content, comprising, going from the outside to the inside of the structure, (1) a steel jacket (6);

(2) a water-cooled copper wall (7);

(3) water-cooled copper ledges (8) extending towards the inside;

(4) a lining (9) of refractory material resting on the ledges (8), wherein the ledges (8) are vertically movable on assembly of the wall.

2. Refractory wall structure (1) in accordance with claim 1, wherein at the top the ledges (8) extend upwards towards the inside obliquely.

3. Refractory wall structure (1) in accordance with claim 1, wherein at the bottom the ledges (8) extend downwards towards the inside obliquely.

4. Refractory wall structure (1) in accordance with claim 1, wherein the ledges (8) are distributed over the height of the wall.

5. Refractory wall structure (1) in accordance with claim 1, wherein the water-cooled copper wall (7) is composed of panels (21).

6. Refractory wall structure (1) in accordance with claim 1, wherein the ledges (8) are staggered in height up the width and/or circumference.

7. Refractory wall structure (1) in accordance with claim 1, wherein the lining (9) rests on the ledges (8) without mortar.

8. Refractory wall structure (1) in accordance with claim 1, wherein the lining (9) bears against the water-cooled wall (7) without mortar.

9. Refractory wall structure (1) in accordance with claim 1, wherein the lining (9) is composed of blocks of graphite (10) with a coefficient of thermal conductivity in the range 60–150 W/m° K.

10. Refractory wall structure (1) in accordance with claim 1, wherein the lining (9) is composed of blocks of semi-graphite with a coefficient of thermal conductivity in the range 30–60 W/m° K.

11. Refractory wall structure (1) in accordance with claim 1, wherein the lining (9) comprises refractory bricks.

12. Refractory wall structure (1) in accordance with claim 11, wherein the bricks (11) are of a type that is used in converters for steel production or in electric furnaces for steel production.

13. Refractory wall structure (1) in accordance with claim 11, wherein the bricks (11) are magnesite-carbon bricks.

14. Refractory wall structure (1) in accordance with claim 1, wherein going from the outside to the inside, the lining comprises of a layer of graphite (10) which bears against the copper wall (7) and a layer of refractory bricks (11).

15. Refractory wall structure (1) in accordance with claim 1, wherein it inclines backwards from bottom to top.

16. Refractory wall structure (1) in accordance with claim 1, wherein the copper wall (7) and/or the copper ledges (8) comprises of red copper with a content of ≧99% Cu and a coefficient of thermal conductivity in the range 250–300 W/m° K.

17. Refractory wall structure (1) in accordance with claim 1, wherein the steel jacket (16) forms part of a pressure vessel and the passages (17, 18, 20) through the steel jacket (16) of cooling water feed and discharge pipes of the water-cooled copper wall (7) and the water-cooled copper ledges (8) are sealed following assembly of the wall.

18. Refractory wall structure (1) in accordance with claim 1, wherein it is capable of withstanding, for a service life of at least 6 months continuous use, a thermal load of over 300,000 W/m$^2$ and slag with approximately 10% wt. FeO at a temperature level of approximately 1,700° C.

19. Refractory wall structure (1) in accordance with claim 1, wherein the structure has a service life of at least 6 months continuous use.

20. Metallurgical vessel comprising a refractory wall structure (1) comprising, going from the outside to the inside, (1) a steel jacket (6);

(2) a water-cooled copper wall (7);

(3) water-cooled copper ledges (8) extending towards the inside;

(4) a lining (9) of refractory material resting on the ledges (8);

in accordance with claim 1, wherein-the ledges (8) are vertical movable on assembly of the wall.

21. Method for a continuous production of crude iron by a reduction process comprising the steps of:

reducing iron ore in a metallurgical vessel comprising, a refractory wall structure (1), in accordance with claim 1, within the vessel.

22. Refractory wall structure (1) in accordance with claim 1, wherein the ledges are located a distance from the top of the plate to which it is attached and a distance from the bottom of the plate to which it is attached.

23. Refractory wall structure (1) in accordance with claim 1, wherein the ledges have respective body portions having a trapezoidal vertical cross-section.

* * * * *